United States Patent [19]

Lacis et al.

[11] 4,148,000

[45] Apr. 3, 1979

[54] REED SWITCH CONSTRUCTION

[75] Inventors: Laimons Lacis, Bloomfield; Steven Horvath, Irvington, both of N.J.

[73] Assignee: Gordos Corporation, Bloomfield, N.J.

[21] Appl. No.: 859,823

[22] Filed: Dec. 12, 1977

Related U.S. Application Data

[62] Division of Ser. No. 648,861, Jan. 14, 1976, Pat. No. 4,085,392.

[51] Int. Cl.[2] ..... H01H 1/08

[52] U.S. Cl. ..... 335/58; 335/47; 335/154

[58] Field of Search ..... 335/58, 47, 57, 55, 335/154, 196, 151; 200/199

[56] References Cited

U.S. PATENT DOCUMENTS

| | | | |
|---|---|---|---|
| 3,114,811 | 12/1963 | Kohman | 335/58 |
| 3,716,810 | 2/1973 | Hara et al. | 335/154 |

*Primary Examiner*—Harold Broome

*Attorney, Agent, or Firm*—Dann, Dorfman, Herrell and Skillman

[57] ABSTRACT

The magnetic elements of a mercury reed switch are supported within their non-magnetic capsule so that, instead of coming into contact in initially overlapping relationship, under the influence of a magnetic field they become essentially aligned with one another. The reeds are so constructed that by selection of the size or shape of their respective opposed ends, the magnetic flux pattern is modified to maintain desired relative alignment to achieve desired spacing between solid contacts. In a preferred form at least one of the magnetic elements carries a substantially non-magnetic conductive extension means, conductively affixed to its supporting element in position to complete an electrical circuit from its supporting element through intermediate conductive liquid and the other reed element in some switch condition.

8 Claims, 4 Drawing Figures

REED SWITCH CONSTRUCTION

This is a division of application Ser. No. 648,861, filed Jan. 14, 1976, now U.S. Pat. No. 4,085,392.

The present invention relates to an improved mercury wetted reed switch. More specifically, the present invention concerns a reed switch in which the switch contact ends of the magnetic elements are arranged so that they will not overlap and so that means extending at least one of the magnetic elements completes a circuit through the intermediate mercury to the other magnetic element in one of the stable reed positions or in passing.

In their simplest form reed switches in the prior art have characteristically employed a pair of electrically conductive, magnetic reed elements supported by a glass capsule, or other rigid non-magnetic supporting means, in positions relative to one another such that when no magnetic field is applied the magnetic elements assume positions separated from one another by a small gap. When a magnetic field is applied, magnetic flux lines concentrate into the low magnetic reluctance magnetic elements and the magnetomotive force will cause the magnetic elements to pull together in overlapping and electrically contacting relationship to simultaneously reduce magnetic reluctance and complete an electrical circuit through the contacting area of the electrically conductive magnetic elements. When the magnetic field is removed, the inherent resilience of at least one of the magnetic elements causes them to return to their normally separated condition.

Particularly in dry switches, there has been a tendency for contact bounce to occur, when the magnetic reed elements are drawn into contact with one another. That is, the inertia of the opposed magnetic elements causes them to bounce away from one another under the impact of contact, and there may be an undesirable period of making and breaking of the contacts until the energy involved producing the bouncing is absorbed and the oscillation is damped. In many applications this contact bounce is considered intolerable. It was for this reason, perhaps among others, that mercury wetted reed relay contacts were invented in the first place.

Whatever the reason, in some instances in the prior art mercury has been applied to the contact surfaces in order to obtain positive uniform contact between the magnetic elements. The mercury prevents intermittent circuit breaks after closure due to "contact bounce". However, in such switches the mercury may tend to amalgamate, or otherwise take on metals of supports and other switch parts, and some of the alloys or components formed may crystallize into solid form. Under these circumstances if contacts are together for long periods of time, or at elevated temperatures, they may tend to stick together instead of opening under the magnetic forces or the restoring force of the inherent resiliency of at least one of the magnetic elements when the magnetic field is removed. Characteristically, the mercury between the contacts does not prevent a direct metal-to-metal contact between the magnetic elements or at least a very close proximity of the contacts. Under conditions where the spacing between solid metal magnetic element of the contacts is less than the dimension of crystals of mercury amalgams, and the like, switch contacts have tended to stick closed at high temperatures or under conditions of long closure.

The present invention employs magnetic reed elements which do not overlap and therefore never come directly into contact with one another. Instead the magnetic elements are arranged so that they are effectively essentially axially aligned when the magnetic flux is applied. At least one of the magnetic elements carries means conductively extending its supporting magnetic element and positioned to complete an electrical circuit from its supporting magnetic element through the other magnetic element and intermediate mercury. Reed switch movement is accomplished, just as it has been in the past, by alternate application of a magnetic field and removal thereof. Application of the magnetic field forces the magnetic elements in opposition to their internal natural resilience, or other restoring force, to assume a stable reluctance minimizing position of axial alignment. Removal of the magnetic field causes the magnetic elements to resume the stable positions previously occupied before magnetic force is applied in response to their natural resilience. The extension means in the course of movement from one stable position to the other performs at least a momentary change in switch contact condition. In preferred forms the extension is preferably a solid substantially non-magnetic member which overlaps the non-supporting magnetic member. In most switch arrangements in one stable position the extension member effectively completes the circuit from element through intervening mercury to element. In the other stable position the elements separate to open the circuit. Alternatively, contacts may be arranged to momentarily complete a circuit in passing between the two stable open circuit positions. Or the reverse may be true, the contacts may be open only briefly in passing from one closed contact position to another, possibly in a different circuit.

More specifically, the present invention concerns a reed switch employing magnetic elements of conductive, magnetic material, at least one of which is movable such that in the presence of a magnetic field said magnetic elements will change contact condition, such that at least one element moves to a magnetic reluctance minimizing position, in which position said magnetic elements are axially aligned, or more nearly so, but not contacting. A rigid non-magnetic envelope supports the magnetic elements in predetermined non-aligned position relative to each other. The same envelope contains mercury which is arranged to reach and wet the contacts to close the switch. A solid substantially non-magnetic metallic extension element is fixed to its supporting magnetic element to extend in the general direction of the magnetic elements and overlap the other magnetic element. Movement is in response alternately to magnetic element aligning force and at least another force restoring at least one movable element to another stable position. Frequently, this restoring force is the internal resilience of the moving magnetic or its support. Contact is completed by moving the extension normally into the other magnetic element much like reed-to-reed contact of the prior art.

The present invention may employ contouring of the opposed ends of the magnetic elements as well as non-uniform element sizes to produce flux redistributing pole pieces in order to determine a slightly off-axis stable position for the reeds as an aid in the spacing the extension member from the non-supporting magnetic element. Closed contact separation of the solid metal surfaces may be selected such that mercury thickness completing the circuit is greater than the maximum crystal size of a possible amalgam. Separation of the solid metal surfaces at the contacts in the stable closed-contact position of the magnetic elements may prevent crystal bridging and consequent sticking. Additionally, contact bounce may be eliminated or greatly reduced by preventing or reducing the intensity of metal-to-metal contact but still permitting close enough approach to produce mercury bridging.

For a better understanding of the present invention, reference is made to the following drawings, in which.

Figure 3A:
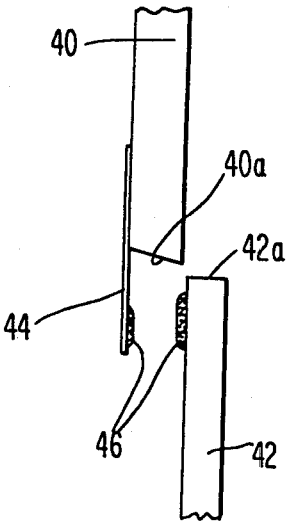
Figure 3B:
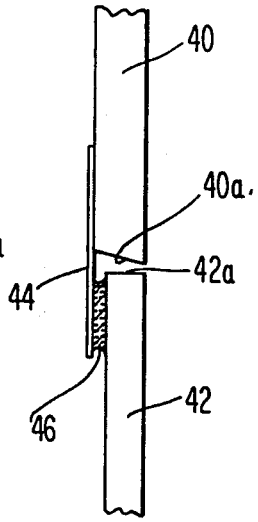
Figure 4A:
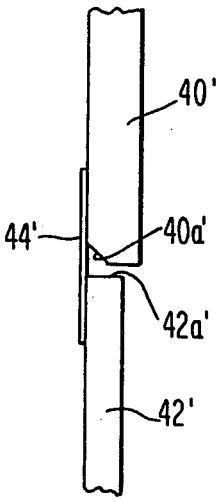
Figure 4B:
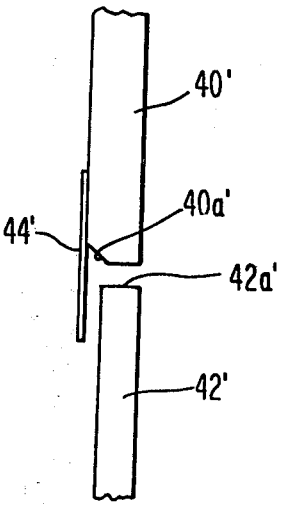
Figure 5A:
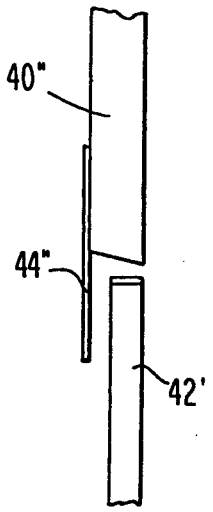
Figure 5B:
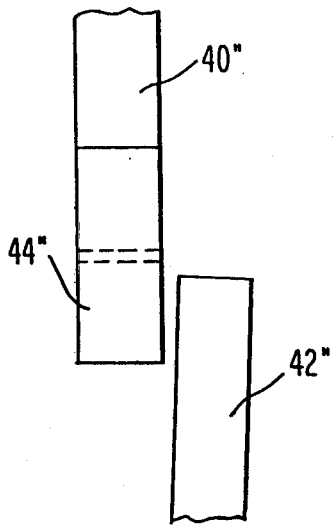
Figure 5C:
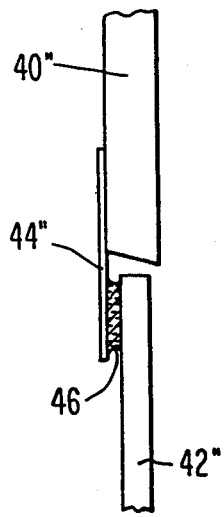
Figure 5D:
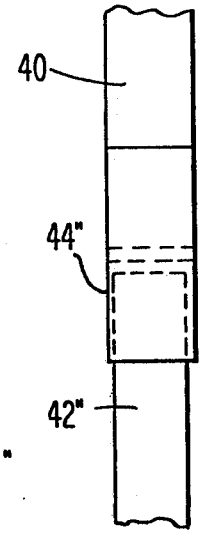
Figure 6A:
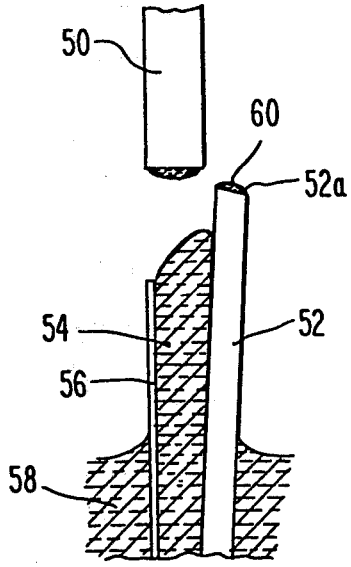
Figure 6B:
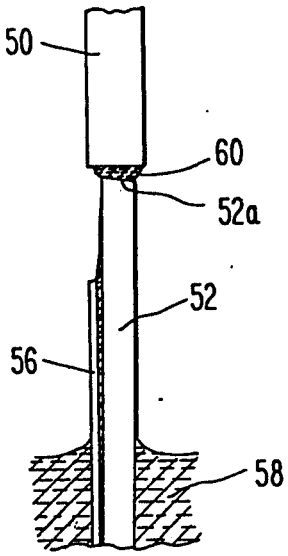

FIG. 3*a* is a greatly enlarged diagrammatic view of the contact area region of an improved reed switch employing mercury wetted contacts in accordance with the present invention in magnetic field removed, open-contact condition; and FIG. 3*b* is a similar view of the switch contacts of FIG. 3*a* in magnetic field applied, closed-contact condition.

Figure 1:
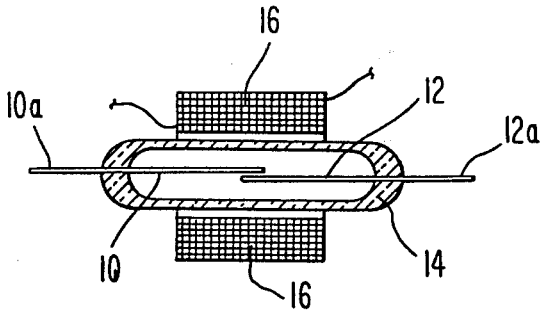
PRIOR ART Fig. 1
FIG. 1 shows in axial section the simplest type of prior art reed switch and the winding constituting together a reed relay.

Referring to FIG. 1, the simplest type of reed switch is illustrated. In this structure a pair of flexible resilient, conductive, magnetic reed elements 10 and 12 are shown supported by a glass, or other insulating non-magnetic, in their normally open condition by envelope 14, which might be any other rigid non-magnetic supporting means. However, when current flows through coil 16 surrounding the envelope 14, the generally axial magnetic field seeks the highly permeable path of the magnetic elements 10 and 12 and flux lines crowd into that low magnetic reluctance path. The magnetic flux crosses the high reluctance air gap between the reeds and sets up a magnetomotive force tending to draw the flexible reeds together. The ends 10*a* and 12*a* of the magnetic reed elements outside of the envelope 14 are used as terminals to connect the magnetic elements, which are also conductive, in series in an electrical circuit. A normally open switch, as shown, will close upon application of a magnetic field and reopen under the resilient restoring forces of the magnetic reed elements upon removal of the magnetic field.

Figure 2:
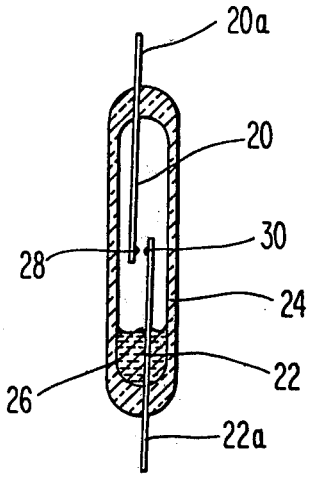
PRIOR ART Fig. 2
FIG. 2 is a similar sectional showing of a prior art mercury reed switch over which the present invention offers improvement.

A variation of the reed switch illustrated in FIG. 1 is shown in FIG. 2. Referring to FIG. 2, the illustrated switch comprises a pair of magnetic reed elements 20 and 22 within and supported by a glass envelope 24. The envelope may also be made of other non-magnetic material which is also preferably insulating, or even conductive with insulating inserts to insulate the supported conductors from one another. In this embodiment, the verticle orientation is employed in operation to locate the mercury pool 26 which feeds the contacts with mercury through capillary grooves in magnetic element 22 or by other conventional means. Both magnetic elements in a mercury reed switch are commonly made of an alloy, such as 52 alloy (consisting of essentially 52% nickel and 48% iron). The opposed facing internal contact regions at the end of each magnetic element 20 and 22 are provided with contacts 28 and 30, respectively. The magnetic elements 20 and 22 also serve as electrical connectors or terminals in those portions 20*a* and 22*a* outside of the glass envelope 24. Again, a coil similar to that used with FIG. 1 may supply the magnetic field to actuate this switch. In this particular embodiment, both magnetic elements are flexible and rely on their own internal resilience to return from closed-contact position to the open position shown upon removal of the magnetic field.

In other embodiments of the prior art, only other than internal resilience of the magnetic elements may be used. In some embodiments, the movable element is a flexible reed or swinger. The mercury 26 may be pure mercury, or it may be saturated with selected dopant, or may have a piece of oxygen-free high conductivity copper wire within the mercury pool to cause the mercury to become copper saturated.

In practice, with mercury wetted contacts, amalgamation has been a problem, even though it may be minimized or reduced, and the prior art has been directed primarily to a minimizing of the amalgamation or crystal formation within the mercury. Part of the problem is that over a period of time, particularly with the contacts closed, crystal formation between the contacts may cause the contacts to stick. We have determined, however, that it is crystal growth of a size on the order of the spacing between the contacts which produces the problem. That is, the contacts themselves are normally in direct contact or in a very close proximity with the mercury simply filling any gap and improving the contact.

In our invention, because of the geometries intentionally employed for the first time, the contacts at their closest approach are always separated by a greater distance than the size of crystals, which distance is filled with mercury to complete the circuit. Therefore, formation of crystals if it occurs, is not deleterious to the operation of the switch. However, even though our invention is of particular advantage with mercury switches, much of the geometry and movement employed is applicable and of advantage in dry switch construction as well as in mercury switches.

Observation of FIGS. 1 and 2 makes it clear that, as a matter of conventional practice, the magnetic elements in so-called reed switches have been overlapping, with the switches in most cases being closed by pulling the magnetic elements together under the effects of magnetic flux. In accordance with our invention, instead of overlapping the magnetic reed elements, these elements are terminated short of each other so as to completely pass one another and to be drawn into axial alignment in order to reduce magnetic reluctance.

FIGS. 3*a* and 3*b* illustrate somewhat schematically, and greatly enlarged, the contact area of the internal ends of the two magnetic elements of a reed switch in accordance with the present invention, respectively, in open and closed contact condition. The magnetic reed elements 40 and 42 do not overlap one another laterally as in the prior art. FIG. 3*a* shows the magnetic elements out of alignment in a stable initial position assumed, and resumed when no magnetic field is present. FIG. 3*b* shows the same elements drawn into alignment by the imposition of a magnetic field. Magnetic flux concentrates into the magnetic structure of the magnetic elements and draws them into axial alignment in order to minimize the reluctance of the magnetic path by reducing the air gap to a minimum. In this structure, as a variation over that of FIG. 2, for example, magnetic element 40 may be a fixed pole piece and magnetic element 42, a mercury wetted armature. In the embodiment illustrated in FIGS. 3*a* and 3*b*, pole 40 is of larger diameter than armature 42 and at the side remote from the closest approach of the two reeds. A non-magnetic extension 44 in the form of an elongated piece of electrically-conductive material is attached to pole 40 such that the extension overlaps the armature 42 in the generally axial direction. In the magnetically actuated position of the magnetic elements, pole 40 and armature 42, shown in FIG. 3*b*, the armature 42 approaches the extension 44 but does not contact it. In their magnetically actuated stable position, there is a spacing between extension 44 and the armature 42 greater than the size of crystals which tend to form in mercury due to amalgamation. Armature 42 is mercury-wetted in the contact area from a mercury pool similar to that in the structure of FIG. 2, for example. The contact area is fed mercury through capillary grooves in armature 42. A bridge of mercury 46 from armature 42 will contact extension 44 to electrically complete the circuit between the two reeds.

As shown in FIGS. 3*a* and 3*b*, the end 40*a* of pole piece 40 has a chamfered face, not parallel to the opposed squared face of armature 42. Magnetic flux tends to crowd toward that edge which provides the smallest air gap and that edge may align to one side of the axial center, as shown in FIG. 3*b*, into a stable off-center position of minimum reluctance. By designing the shape or contour of the opposed faces of the magnetic elements, the stable position of the elements under the magnetic field may be varied. The position finally assumed will be that position which minimizes the reluctance of the magnetic path. In accordance with the present invention, then, it is possible to shape or contour either or both the faces of the magnetic elements, here 40*a* and 42*a* relative to one another to achieve any desired realignment of the magnetic elements. Movement between the position of FIG. 3*a* and the position of FIG. 3*b* is due to magnetic forces. Return to the position of FIG. 3*a*, after the magnetic field is removed, is due to inherent resiliency of the armature 42 or to suitable spring means connecting the armature to a terminal member or to other restoring force effects known in the prior art, including different magnetic field effects. In practice, when armature 42 is pulled into alignment with pole piece 40 by a magnetic field, it will not tend to overshoot and bounce off the contact, as in the prior art, because it does not reach the metal of the contact. Whatever bounce may occur is less than the distance sufficient to break the mercury bridge. The design of the switch will cause the contacts to seek a stable position in which the spacing of the solid metal parts is greater than the size of crystals which may be formed in the mercury amalgamation process.

Because the danger of crystal bridging is eliminated by the contact spacing in the present invention, it is possible to utilize pure mercury and to avoid the use of special alloy contacts to reduce the amalgamation process.

In the discussion herein, one extension means of essentially non-magnetic conductive material is considered. However, each element could be provided with an extension. More complex multiple extensions or branched extensions can also be used, if desired.

Should the reed switch of the present invention contain mercury wetted contacts, no dopant or other material need be employed for the purpose of preventing contact sticking due to crystallization. In fact, pure mercury can be used and no special precautions need be taken about the metals used for contacts. The extension means may be caused to approach the other magnetic element so that in stable position is it is not as close to the other reed through which the electrical path is completed as the largest possible crystal which would be formed by a mercury amalgam.

Various embodiments of the present invention have been described and certain variations therefrom have been mentioned. It will be appreciated by those skilled in the art that the present invention applies most broadly to the concept of the geometry of magnetic reed element alignment wherein the magnetic elements do not overlap and that variations described are intended to be representative but in no way limiting. The structure is intended to be applicable to any type of reed switch presently known as well as structure which may hereafter develop. Many other modifications will occur to those skilled in the art. All such modifications within the scope of the claims are intended to be within the scope and spirit of the present invention.

We claim:

1. A reed switch employing magnetic elements of conductive, magnetic material, at least one of which is movable such that in the presence of a magnetic field said magnetic elements will move to a magnetic reluctance minimizing position in which position said elements are more nearly axially aligned but not contacting, a rigid non-magnetic, non conductive enclosure through which said magnetic elements extend and by which said magnetic elements are supported in predetermined non-aligned position relative to each other, a solid conductive extension on at least one of said magnetic elements conductively extending said element in position to alternately complete and break an electrical circuit through opposed contact areas on said extension and the other magnetic element which in closed contact position do not actually contact one another but are spaced apart a small distance, said contact areas being alternately designed to assume closed position when the magnetic elements are aligned or when at least one movable magnetic element assumes another stable position in the absence of a magnetic field in response to a restoring force, and a conductive liquid within said envelope arranged to circulate into and out of a reservoir and to at least one of the opposed contact areas to fill the small distances between the contacts in closed positions and thereby complete a circuit through the magnetic elements.

2. The reed switch of claim 1 in which the means extending said at least one magnetic element is a solid element which is supported from one element and overlaps the other element or an extension thereof.

3. The reed switch of claim 2 in which the at least one movable magnetic element employs resilient means to return that element to a stable position other than the one achieved by imposing the magnetic field.

4. The reed switch of claim 3 in which the resilient means is the internal resilience of the magnetic element itself.

5. The reed switch of claim 2 in which the extension is positioned such that movement to change contact condition is toward and away from the contact areas in a direction generally normal thereto.

6. The reed switch of claim 1 in which the opposed ends of the magnetic elements are formed to modify the alignment position of the magnetic elements to keep the contacts separated from direct metal contact when the switch is closed by imposition of the magnetic field.

7. The reed switch of claim 5 in which the switch is normally closed and imposition of the magnetic field causes the contacts to separate.

8. The reed switch of claim 7 in which the switch is a mercury switch and the rest position imposed by the restoring force moves the contacts into closed contact condition without solid metal contact.

* * * * *